US005439110A

United States Patent [19]

Regan, II

[11] Patent Number: 5,439,110

[45] Date of Patent: Aug. 8, 1995

[54] TWO-TIERED ARTICLE PACKAGE

[75] Inventor: Timothy J. Regan, II, Marietta, Ga.

[73] Assignee: Riverwood International Corporation, Atlanta, Ga.

[21] Appl. No.: 260,849

[22] Filed: Jun. 16, 1994

[51] Int. Cl.[6] ..... B65D 65/00; B65D 75/00

[52] U.S. Cl. ..... 206/427; 206/148; 206/149; 206/197; 206/199

[58] Field of Search ..... 206/427, 148, 149, 197, 206/199, 932

[56] References Cited

U.S. PATENT DOCUMENTS

| | | | |
|---|---|---|---|
| 1,176,932 | 3/1916 | Smith | 229/932 |
| 2,665,026 | 1/1954 | Katzman | 206/427 |
| 2,755,923 | 7/1956 | Guilleminot et al. | 206/427 |
| 3,904,036 | 9/1975 | Forrer | 206/427 |
| 3,994,432 | 11/1976 | Kirby, Jr. | 206/427 |
| 5,009,314 | 4/1991 | Arthurs | 206/427 |
| 5,071,026 | 12/1991 | Apps | 206/427 |
| 5,328,024 | 7/1994 | Sutherland | 206/427 |

*Primary Examiner*—Jimmy G. Foster
*Assistant Examiner*—Tara L. Laster

[57] ABSTRACT

A carton containing two tiers of necked bottles. The bottles in the upper tier are inverted from the bottles in the lower tier, with the bottle necks of the upper tier extending between the bottle necks of the lower tier. The bottle necks extend through spaced separator sheets containing flaps that prevent contact between adjacent bottle necks. Partitions prevent contact between adjacent bottles in each tier. The carton is sloped in to a relatively small top panel, and the top panel is provided with a handle.

12 Claims, 3 Drawing Sheets

TWO-TIERED ARTICLE PACKAGE

FIELD OF THE INVENTION

This invention relates to the packaging of bottles or other articles having an end portion of reduced dimensions. More particularly, it relates to a carton containing two tiers of such articles.

1. Background of the Invention

Beverage bottles are currently packaged in a variety of different types of carriers, including basket style carriers which employ cells on either side of a handle panel for individually receiving each bottle, open-ended wrap-around carriers and fully enclosed carriers. Each type of carrier is, however, limited in a practical sense as to the number of bottles it can carry. The large bulk of a carrier designed to hold twenty-four bottles, for example, would make it too cumbersome to handle. When this many bottles are supplied as a unit, they are conventionally packaged in a case which require both hands to lift it. Further, its size prevents the case from being stored in most refrigerators.

It would be highly desirable to have a carrier for packaging large numbers of bottles which is capable of being readily lifted and carried by one hand. It would also be desirable to be able to store such a carrier in a refrigerator.

2. Brief Summary of the Invention

The invention comprises a carton containing articles having a relatively small end portion and an opposite relatively large end portion. Necked bottles are exemplary of such articles.

The carton, which includes side and end panels connected to bottom and top panels, contains a lower tier of articles and an upper inverted tier. The articles in the lower tier are arranged so that their large end portion is adjacent the bottom panel and the articles in the upper tier are arranged so that their large end portion is adjacent the top panel, with the small end portions of the articles in the upper tier extending between adjacent small end portions of the articles in the lower tier. In addition, means are provided for separating the articles in the tiers from each other. In the preferred embodiment this comprises an upper sheet containing openings through which the small end portions of the articles in the upper tier extend and a spaced lower sheet containing openings through which the small end portions of the articles in the lower tier extend. Flaps surrounding the openings prevent the small end portions of the articles from contacting each other. In addition, partitions between the bottles in each tier prevent those bottles from contacting each other.

The inverted upper tier contains fewer articles than the lower tier and the top panel preferably is of smaller size than the bottom panel, with the side and end panels including upper portions sloping to the top panel.

The package preferably is provided with a handle enabling it to be lifted and carried by one hand even though it may contain a large number of heavy articles. The articles are securely anchored in the carton against movement and do not come directly into contact with each other, thereby preventing breakage.

Other aspects and benefits of the invention will be readily apparent from the more detailed description of the preferred embodiment which follows.

DETAILED DESCRIPTION OF THE PREFERRED EMBODIMENT

Figure 1:
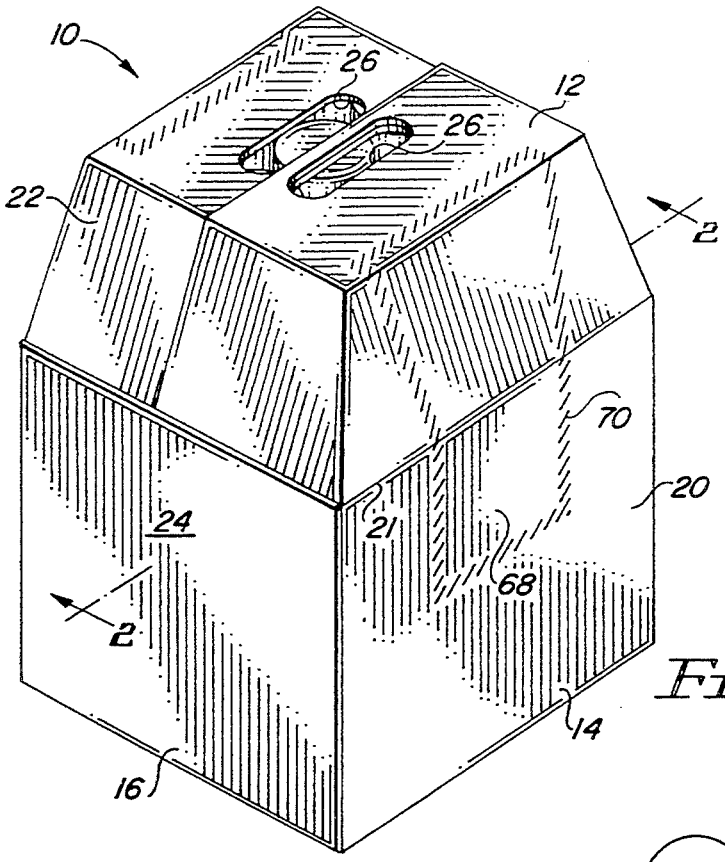
FIG. 1 is a pictorial view of the carrier of the invention.

Referring to FIG. 1 of the drawing, a carrier 10 is comprised of a top panel 12, side panels 14, end panels 16 and a bottom panel not visible in this view. The side panels are comprised of inwardly sloped upper portions 18, which are foldably connected to the top panel, and vertical lower portions 20, which are foldably connected to the bottom panel. A fold line 21 connects the upper and lower side panel portions 18 and 20 to each other. The end panels are also comprised of inwardly sloped upper portions 22 and vertical lower portions 24, which are not integrally connected but are formed from adhered flaps, as described below. The top panel, which includes spaced handle openings 26, is thus of smaller size than the bottom panel.

Figure 2:
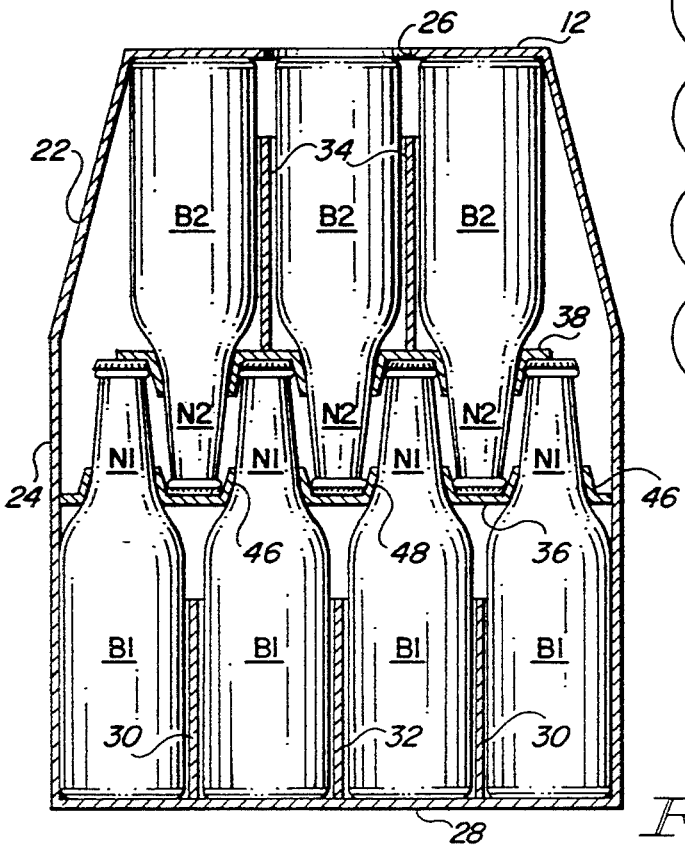
FIG. 2 is a vertical sectional view taken on line 2—2 of FIG. 1.

Unlike conventional carriers which are designed to hold a single layer of bottles, the carrier 10 contains two layers or tiers of bottles. As illustrated in FIG. 2, a first tier of upright bottles B1 is supported on the bottom panel 28 and a second tier of inverted bottles B2 is located above the first tier, with the bottom of the bottles B2 being adjacent the top panel 12. Direct contact between the bottles of the first tier is prevented by partitions 30 and 32, while direct contact between the bottles of the second tier is prevented by elements of partition 34. The bottles are further held in place by a lower relatively large separator sheet 36 and an upper relatively small separator sheet 38. Both separator sheets contain openings through which the necks of the bottles extend, as explained more fully below.

Figure 3:
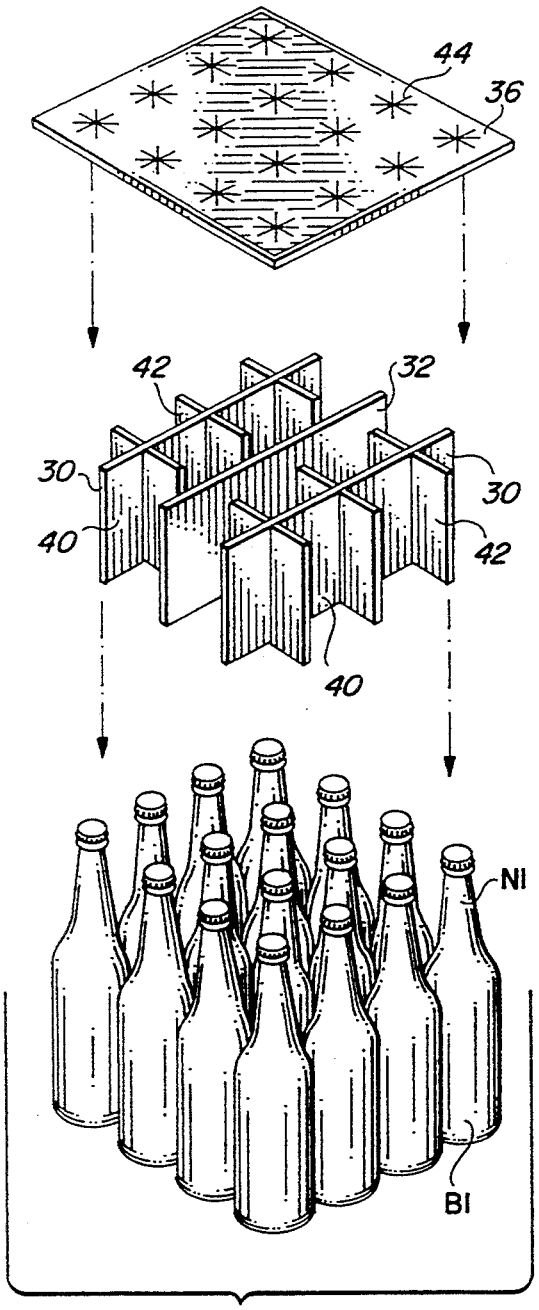
FIG. 3 is a pictorial view illustrating an initial step in the formation of a package.

To form a carrier for packaging twenty-five bottles, the bottles B1 are arranged in four rows containing four bottles each, as illustrated in FIG. 3. Partitions 30 and 32 are then inserted between the bottles so as to provide barriers to contact between adjacent bottles. This is accomplished by utilizing two identical partitions 30 each of which includes a central elongated panel 40 and three spaced cross panels 42. The panels of each partition 30 fit between the bottles in the outer two rows. The partition 32 consists only of a single elongated panel which extends between the bottles in the second and third rows. Each bottle is thus prevented from directly contacting an adjacent bottle in the bottom tier.

Figure 4:
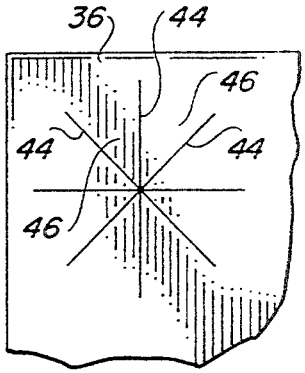
FIG. 4 is an enlarged partial plan view of a separator sheet incorporated in the carrier.

The separator sheet 36 is then positioned so that the necks N1 of the bottles B1 are aligned with the openings in the sheet. As shown in FIGS. 3 and 4, the sixteen openings in the sheet 36 are formed by a number of slits 44 which intersect at a common central point to form pie-shaped segments 46 between the slits. As the separator sheet is moved down over the bottle necks, the bottle necks push against the segments 46, flexing them up as if they were flaps to create openings which receive the necks N1. This arrangement is illustrated in FIG. 2, which shows the segments or flaps 46 of a bottle neck opening 48 in the separator sheet 36 flexed up against the bottle neck N1. The size of the openings is related to the dimensions of the bottles so that the separator sheet is prevented by the larger diameter of the barrel of the bottles from moving down beyond the lower end of the neck portions.

Figure 6:
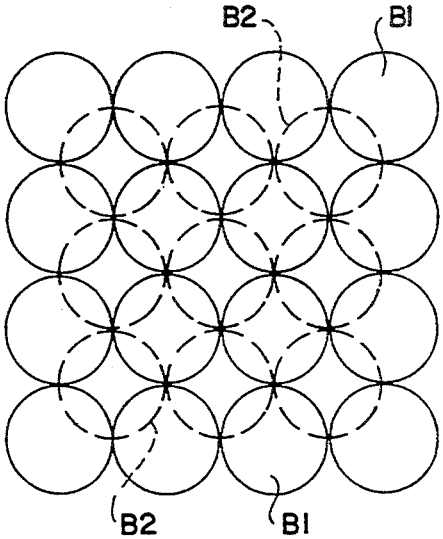
FIG. 6 is a schematic layout of the bottles in a package.
Figure 5:
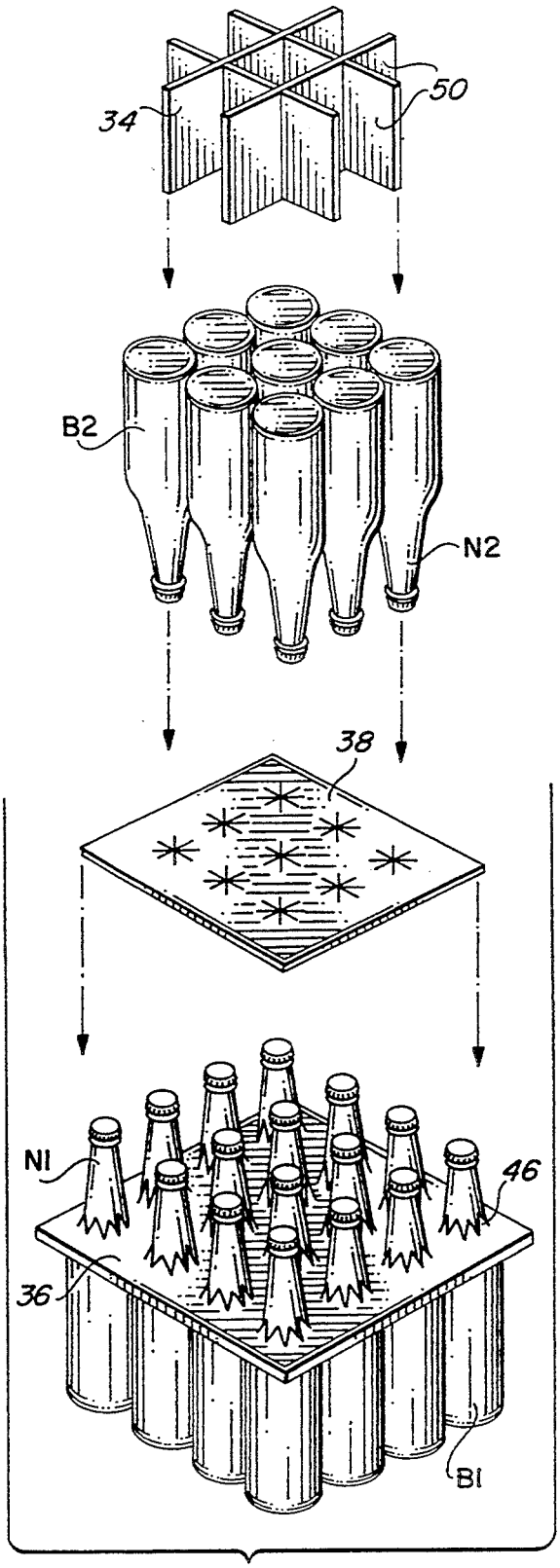
FIG. 5 is a pictorial view illustrating a later step in the formation of a package.

Referring to FIG. 5, the second tier of bottles is then created by applying the separator sheet 38 to a group of nine inverted bottles B2 in the same manner as the sheet 36 was applied, and locating the tier so that the bottle caps of the bottles B2 contact the separator sheet 36. The sheet 38 contains nine openings arranged in three rows of three each, the same as the arrangement of the bottles B2. Optionally, separator sheet 38 may first be positioned on top of the bottles B1 and the inverted bottles B2 moved down through the bottle neck openings in the sheet. In either case the partition 34, which is comprised of two sets of cross panels 50 arranged to create nine cells, is then inserted between the bottles so as to separate all of the bottles B2 from each other. At this point the relationship between the bottles, the partitions and the separator sheets is the same as in the finished carrier, and is shown in FIG. 2. The bottle caps of the bottles B1 contact the sheet 38 and the bottle caps of the bottles B2 contact the sheet 36. The bottle necks N1 and N2 of the bottles are thus positioned between the separator sheets 36 and 38. The bottles of the two tiers are positioned with respect to each other as schematically illustrated in FIG. 6, which shows the bottles B2 to be located in the spaces between the bottles B1. The bottles B2 have been shown in broken lines to more easily differentiate them from the solid lines of bottles B1.

The package is completed by securing the two tiers of bottles within the carrier 10. This may be accomplished by forming a sleeve from a carrier blank and opening the sleeve to the form shown in FIG. 7. As illustrated, the side panels 14 are comprised of integral sections of the blank while the top panel and end panels are formed from flaps. Specifically, flaps 52 are connected by fold lines to the upper sloped side panel portions 18 and flaps 54 are connected by fold lines to the lower vertical side panel portions 20. Upper end flaps 56 are connected by fold lines to the top panel 12 and lower end flaps 58 are connected by fold lines to the bottom panel 28. The tiers of bottles are then loaded into the sleeve through the open end and the end panels are formed by first folding in the flaps 52 and 54, then the flaps 56 and 58. The flaps 56 and 58 are glued to the flaps 52 and 54 and preferably are overlapped and glued to each other. It will be noted that the top panel is formed from overlapping adhered end portions 12A and 12B of the blank and the upper end flaps 56 are formed from overlapping adhered flaps 56A and 56B.

Figure 8:
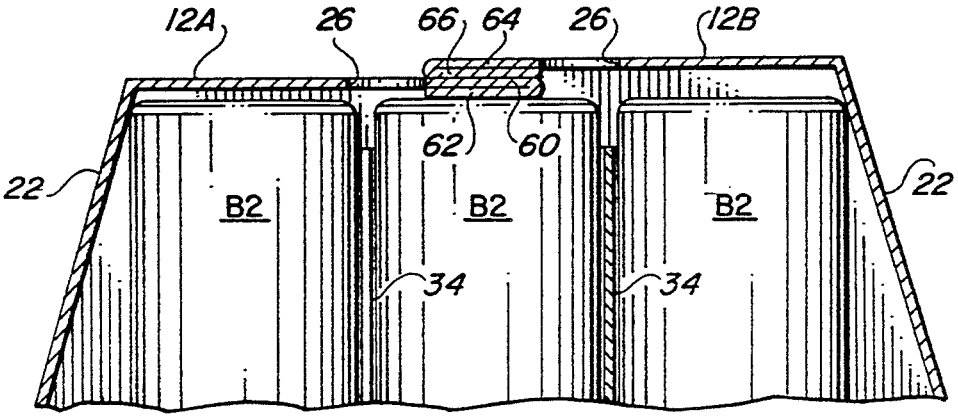
FIG. 8 is an enlarged transverse sectional view of the top panel of the carrier, showing the handle in more detail.

Because the package is heavy, it is preferred that the handle be reinforced in order to resist tearing due to lifting and carrying stresses. This may be accomplished by any suitable handle design, such as that illustrated in FIG. 8, which shows that the overlapping end flaps 12A and 12B terminate in folded edges that provide extra plies in the handle strap. Thus the double edge plies 60 and 62 of flap 12A are located directly beneath the double edge plies 64 and 66 of the flap 12B to form a four-ply handle strap between the handle openings 26. It will be appreciated that the thickness of the carrier flaps has been exaggerated for the sake of clarity, and that in practice the gaps between the bottoms of the bottles B2 and the top panel flaps are much smaller or nonexistent.

Figure 7:
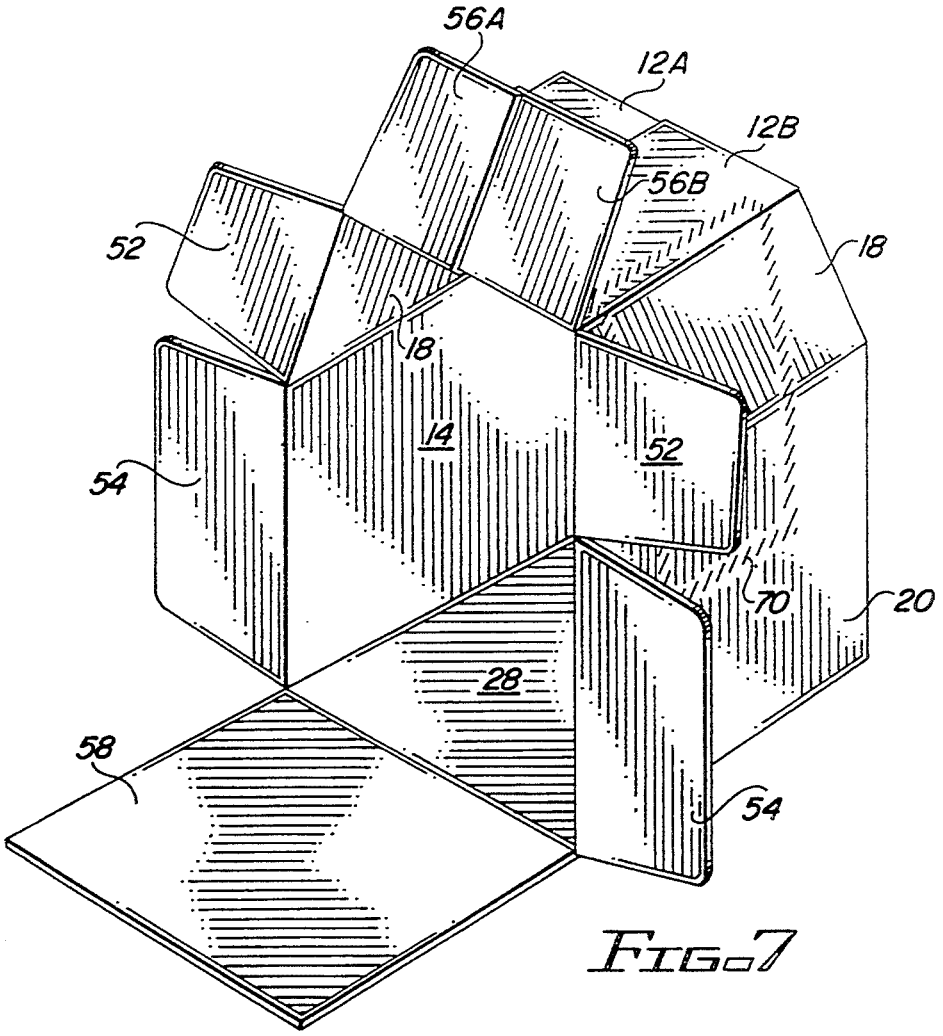
FIG. 7 is a pictorial view of carrier sleeve in position to receive a load of stacked bottles.

Referring to FIGS. 1 and 7, a tear-away section 68 may be provided in the upper side panel sections 18 by a series of cuts 70. After removing the tear-away section, a bottle in the upper tier can readily be removed by first angling it out from the separator sheet 38 before pulling if from the package. The paperboard flaps 46 surrounding each bottle neck opening easily yield when pulling a bottle out from the package.

As can best be seen in FIG. 2, the bottles are held in place and segregated from each other to remove the danger of breakage. The partitions in the upper and lower tiers prevent contact between adjacent bottles in each tier, while the flaps 46 of the separator sheets 36 and 38 prevent contact and relative movement between the bottle necks N1 and N2. Further, relative vertical movement between the bottles B1 and B2 is prevented by the separator sheets. The result is a sturdy, compact package possessing exceptional strength and the ability to protect the packaged bottles from breakage. Because the carrier is compact, containing only four bottles along each of the larger dimensions, it can be carried with one hand, unlike conventional twenty-four packs which have to be lifted at both ends.

The bottle neck openings in the separator sheets need not necessarily be formed from the slit arrangement shown in FIG. 4. For example, the slits 44 can be arranged so as to form fewer or more flaps 46, and they could be spaced apart by a central opening so as not to meet at a central point. The illustrated arrangement is preferred, however, because the resulting flaps effectively surround the necks of the bottles while retaining a sufficiently wide base to strongly bias the flaps against the bottle necks. By not providing a central opening the flaps are long enough to fully extend over the widest portion of the necks and so protect them from contact with the widest portion of adjacent bottle necks.

Although described in connection with a carrier for holding twenty-five bottles, the same carrier can be employed to package the more common number of twenty-four bottles simply by omitting the central bottle in the upper tier. This in no way reduces the strength of the package since the bottles in both tiers are still held in place by the openings in the separator sheet through which their necks protrude, and the bottle necks in both tiers are still separated from adjacent bottle necks by the separator sheet flaps 46.

Changes to the illustrated carrier may be made as desired, as long as the resulting carrier is capable of receiving the separator sheets and tightly holding the tiers of bottles in place. For example, it may be desired to provide beveled corners so as to make the carrier more closely follow the contour of the corner bottles in the package.

It will be appreciated that the same principles described above may be used to provide packages containing fewer bottles. For example, a package containing thirteen bottles can be made up of a lower tier of nine bottles and an upper tier of four bottles. Also, a package containing eighteen bottles can be made up of a lower tier of twelve bottles and an upper tier of six bottles. In the latter case the package would not have a square bottom but would be formed of a lower tier comprised of three rows of four bottles each and an upper tier comprised of two rows of three each.

Although described in connection with the packaging of bottles, the invention may also be utilized to package other types of articles having end portions of reduced size.

It will be understood that the invention is not necessarily limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A package containing articles having a relatively small end portion and an opposite relatively large end portion, comprising:

a carton including side and end panels connected to a bottom panel and a top panel;

a lower tier of articles and an upper tier of articles, the large end portions of the articles in the lower tier being closely spaced from each other and being adjacent the bottom panel and the large end portions of the articles in the upper tier being closely spaced from each other and being adjacent the top panel;

the large end portions of the articles in the upper tier being located above the small end portions of the articles in the lower tier and the large end portions of the articles in the lower tier being located below the small end portions of the articles in the upper tier;

the small end portions of the articles in the upper tier extending between, and being adjacent to, the small end portions of the articles in the lower tier; and means for separating the small end portions of the articles in the upper tier from the small end portions of the articles in the lower tier, said means being comprised of an upper sheet containing openings through which the small end portions of the articles in the upper tier extend and a spaced lower sheet containing openings through which the small end portions of the articles in the lower tier extend.

2. A package as defined in claim 1, wherein the small end portion of each article includes an end surface, the end surfaces of the articles in the lower tier contacting the upper sheet and the end surfaces of the articles in the upper tier contacting the lower sheet.

3. A package as defined in claim 1, wherein the openings in the upper and lower sheets are substantially surrounded by flaps connected to the sheets.

4. A package as defined in claim 3, wherein the flaps are defined by slits in the sheets which intersect at the center of the openings prior to the flaps being pushed aside by the small end portion of an associated bottle.

5. A package as defined in claim 1, including partitions separating the articles in each tier from each other.

6. A package as defined in claim 1, wherein the upper tier contains fewer articles than the lower tier and the top panel is of smaller size than the bottom panel, the side and end panels including upper portions which slope inwardly to the top panel.

7. A package as defined in claim 6, including a handle in the top panel.

8. A package as defined in claim 7, wherein the top handle is comprised of hand openings spaced from each other by a strap integral with the top panel, the strap being comprised of a plurality of plies.

9. A package containing necked bottles, comprising:

a carton including side and end panels connected to a bottom panel and a top panel;

a lower tier of bottles and an upper inverted tier of bottles;

the necks of the bottles in the upper tier extending between, and being adjacent to, the necks of adjacent bottles in the lower tier; and an upper sheet containing openings through which the necks of the bottles in the upper tier extend and a spaced lower sheet containing openings through which the necks of the bottles in the lower tier extend;

the neck of each bottle including a cap, the caps of the bottles in the lower tier contacting the upper sheet and the caps of the bottles in the upper tier contacting the lower sheet.

10. A package as defined in claim 9, wherein the openings in the upper and lower sheets are substantially surrounded by flaps connected to the sheets, the flaps engaging end portions of the necks of associated bottles.

11. A package as defined in claim 10, including partitions separating the bottles in each tier from each other.

12. A package as defined in claim 10, wherein the upper tier contains fewer bottles than the lower tier and the top panel is of smaller size than the bottom panel, the side and end panels including upper portions which slope inwardly to the top panel.

* * * * *